US005933919A

United States Patent [19]

Miller et al.

[11] Patent Number: 5,933,919

[45] Date of Patent: Aug. 10, 1999

[54] ADJUSTABLE DOOR HINGE

[76] Inventors: Erik D. Miller, 5454 Jackwood, Houston, Tex. 77096; George T. Voiland, 5401 Chimney Rock, #685, Houston, Tex. 77081

[21] Appl. No.: 09/049,481

[22] Filed: Mar. 27, 1998

Related U.S. Application Data

[60] Provisional application No. 60/048,269, Jun. 2, 1997.

[51] Int. Cl.[6] ..... E05D 7/04

[52] U.S. Cl. ..... 16/244; 16/241; 16/386; 16/245

[58] Field of Search ..... 16/244, 245, 242, 16/330, 329

[56] References Cited

U.S. PATENT DOCUMENTS 1,465,912 8/1923 Jensen ..... 16/330
1,863,889 6/1932 Wells ..... 16/244
2,779,966 2/1957 Torchia ..... 16/244

*Primary Examiner*—Anthony Knight
*Assistant Examiner*—Alison K. Pickard
*Attorney, Agent, or Firm*—Bill B. Berryhill

[57] ABSTRACT

An adjustable door hinge including a pair of hinge plates, one for attachment to a door and one for attachment to a door jamb. Each of the hinge plates is provided along corresponding juxtapositioned vertical edges thereof with two or more vertically spaced and coaxially aligned tubular guides. At least two guides of one of the hinge plates is provided with internal threads. A threaded bolt extends through each of the tubular guides and threadedly engages the threaded guides of one of the hinge plates. In a preferred embodiment, the non-threaded tubular guides are provided with a rack of parallel teeth. Washers surround the bolt for disposition next to the racked tubular guides. One side of each washers is provided with a corresponding rack of parallel teeth.

10 Claims, 2 Drawing Sheets

ADJUSTABLE DOOR HINGE

CROSS-REFERENCE TO RELATED APPLICATION

This application claims the benefit of U.S. Provisional Application No. 60/048,269 filed Jun. 2, 1997.

BACKGROUND OF THE INVENTION

1. Field of the Invention

The present invention pertains to hinge apparatus. More specifically, the present invention pertains to hinges by which a door is attached to a door jamb for pivoting about a substantially vertical axis between positions in which the door is closed and opened.

2. Description of the Prior Art

Most doors are attached to a door jamb by two or more hinges. Each hinge is typically provided with a pair of hinge plates one for attachment to the door and one for attachment to the door jamb. Each of the hinge plates is normally provided along corresponding juxtapositioned vertical edges thereof with two or more vertically spaced and coaxially aligned tubular guides. A pin member is inserted into the coaxially aligned tubular guides of both hinge plates so that the pair of hinge plates are operatively connected for pivoting about a common substantially vertical axis. When properly installed, the door pivots between closed and opened positions.

From time to time, the door and door jamb may become misaligned so that the door sticks due to binding at the top or sides of the door jamb. This may be due to a number of reasons. For example, the house, building or other structure in which the door is installed may shift due to changes in soil conditions, weather conditions, etc.

If the door is not realigned or if it is improperly realigned it may be a source of heating and air conditioning loss and provide a pathway for unwanted pests. In addition, it may compromise the security of the structure to which the door is attached.

With standard door hinges, misalignment problems are typically corrected by removing the hinge pins so that the door jamb hinge plates and the door hinge plates are separated, allowing the door to be removed. Then the door is planed and/or refitted to the door jamb. This is typically a trial and error procedure which is awkward and time consuming. It requires heavy lifting and may require exacting work with a carpenter's plane. It may mar the door and require refinishing thereof.

SUMMARY OF THE PRESENT INVENTION

The present invention provides an adjustable door hinge by which alignment of the door with the door jamb may be readjusted without having to remove the door from the door jamb and without having to cut or plane the door. The adjustable door hinge of the present invention allows an individual to easily adjust the door, vertically or horizontally, without having to remove the door or without having to modify the door in any manner.

The adjustable door hinge of the present invention provides a pair of hinge plates, one for attachment to the door and one for attachment to the door jamb which are operatively connected for pivoting about a common substantially vertical axis. Each of the hinge plates is provided along corresponding juxtapositioned vertical edges thereof with two or more vertically spaced and coaxially aligned tubular guides. The guides of each hinge plate are alternately disposed in spaces between the guides of the other hinge plate and the longitudinal length of each guide is vertically less than the corresponding space in which it is disposed. At least two guides of one of the hinge plates is provided with internal threads, the internal diameter of the non-threaded guides of the other hinge plate being greater than the root diameter of the internal threads of the threaded guides. An externally threaded bolt extends through each of the tubular guides, the threads of the bolt engaging the internal threads of one of the hinge plates and the head of the bolt resting at the upper end of one of the tubular guides of the other hinge plate. Thus, rotation of the bolt will effect vertical displacement of the hinge plates relative to each other. A nut member may be provided for engagement with the bolt member so that when made up against the lower end of another of the tubular guides, vertical displacement of the hinge plates relative to each other may be limited.

The upper end of one of the non-threaded tubular guides and the lower end of another of the non-threaded tubular guides may be provided with a rack of parallel teeth which are perpendicular to the plane of the hinge plate on which these tubular guides are provided. Washers may be provided for disposition next to the bolt head and next to the nut at the lower end of the bolt, respectively. Each of these washers may be provided with corresponding racks of parallel teeth which may be moved transversely to the rack teeth in selective engagement with an adjacent tubular guide rack to effect horizontal displacement or alignment of the hinge plates relative to each other.

Thus, by simply loosening the bolt and nut, the bolt may be rotated to adjust the hinge plates and the door in a vertical direction and the washers may be transversely moved to effect horizontal displacement, aligning the door up or down and from side to side. This may be accomplished by one individual without removing the door from the door jamb and without modifying the door in any way. No planing or cutting of the door is required and no refinishing of the door is required. Furthermore, if the door becomes subsequently misaligned due to shifting soil and weather conditions it may again be realigned in the same simple manner.

The adjustable door hinge of the present invention is similar to standard door hinges in dimension and can easily replace a standard hinge. While the cost of this hinge may be slightly more, the additional cost will certainly be offset by the savings in time and expense of realigning a door with standard hinges. Many other objects and advantages of the invention will be apparent from reading the description which follows in conjunction with the accompanying drawings.

DESCRIPTION OF A PREFERRED EMBODIMENT

Figure 1:
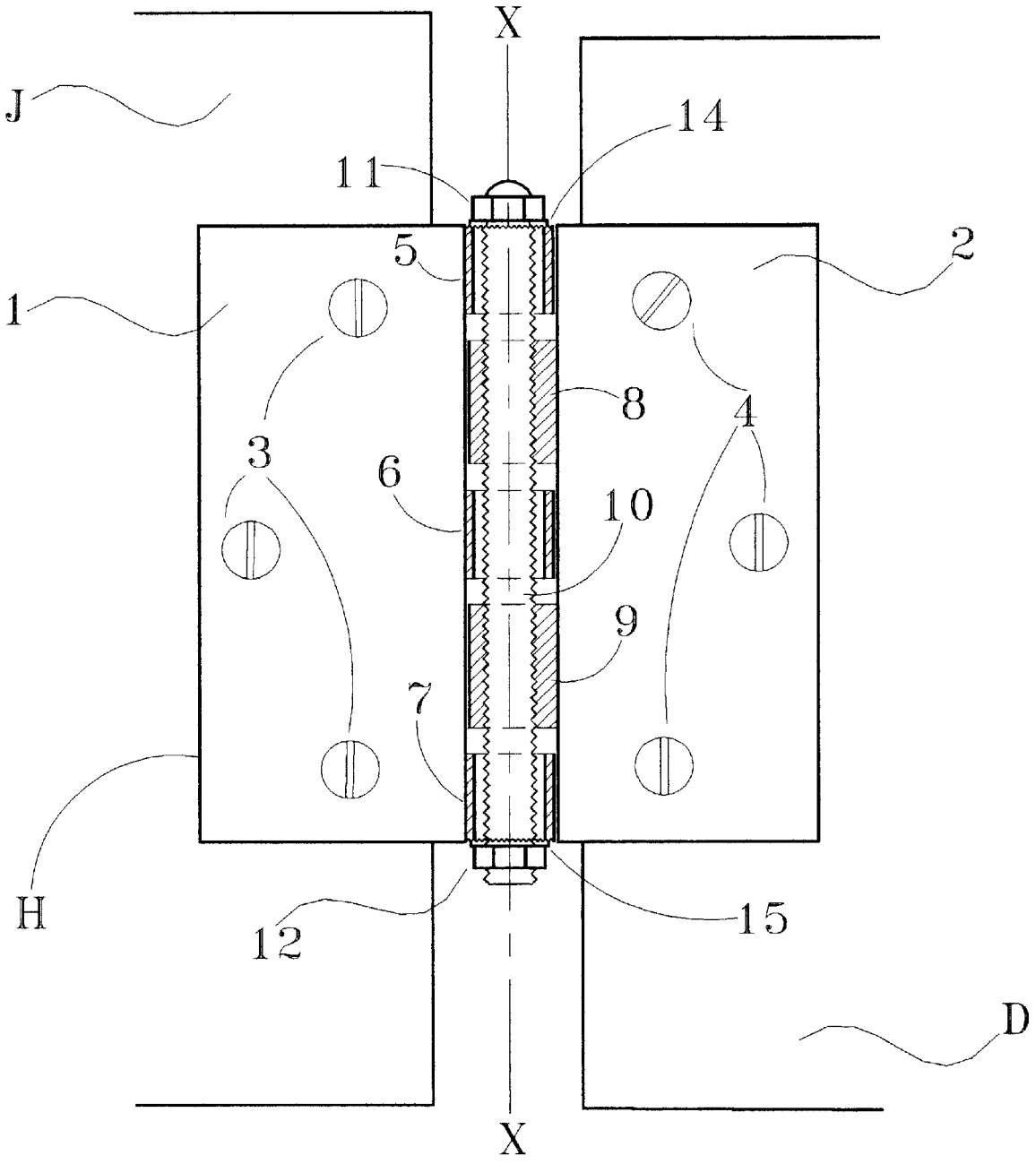
FIG. 1 is an elevation view, partially in section, of an adjustable door hinge, according to a preferred embodiment of the invention, for attachment of a door to a door jamb.

Referring first to FIG. 1 there is shown an adjustable door hinge H for attachment of a door D to a door jamb J according to a preferred embodiment of the present invention. The door hinge H comprises a pair of hinge plates 1, 2 operatively connected for pivoting about a substantially vertical axis X—X. The jamb side hinge plate 1 is provided with holes through which screws 3 may be inserted for attachment of the hinge plate 1 to the door jamb J. Likewise, the hinge plate 2 is provided with holes through which screws 4 may be inserted for attachment of the door D to the hinge plate 2.

Each of the hinge plates 1, 2 is provided along corresponding juxtapositioned vertical edges thereof with two or more vertically spaced and coaxially aligned tubular guides. In the exemplary embodiment, the door jamb hinge plate 1 is provided with three tubular guides 5, 6 and 7 and the door hinge plate 2 is provided with two tubular guides 8 and 9. The guides of each hinge plate are alternately disposed in spaces between the guides of the other hinge plate and the length of each guide is vertically less than the corresponding space in which it is disposed. At least two of the guides of one of the hinge plates, guides 8 and 9 of hinge plate 2 in the exemplary embodiment, is provided with internal threads. The internal diameter of the non-threaded guides 5, 6 and 7 of the other hinge plate 1 are somewhat greater than the root diameter of the internal threads of guides 8 and 9; e.g. 0.25 inches greater.

An externally threaded bolt 10 extends through each of the tubular guides 5, 6, 7, 8 and 9. The threads of the bolt 10 engage the internal threads of the threaded guides 8 and 9. The bolt 10 has a head 11 which may rest at the upper end of one of the non-threaded tubular guides 5 of the hinge plate 1. A nut member 12 may be provided for engagement with the opposite end of the bolt member 10 and when made up against the lower end of tubular guide 7 will limit vertical displacement and rotation of the bolt 10. If the nut 12 is loosened and the bolt 11 rotated it can be understood that the bolt 10 will effect vertical displacement of the hinge plates 1, 2 relative to each other.

Figure 2:
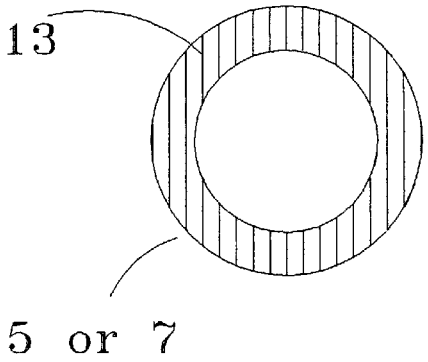
FIG. 2 is a plan view illustrating the upper end of one of the non-threaded tubular guides or the lower end of another non-threaded tubular guide of one of the hinge plates of the adjustable hinge of FIG. 1.
Figure 3:
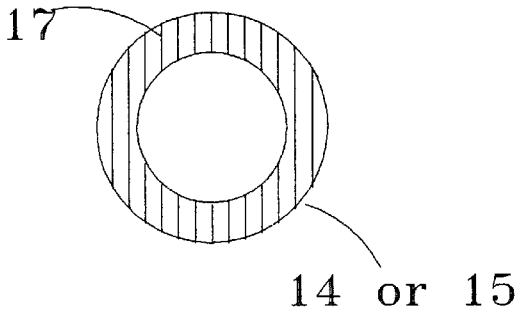
FIG. 3 is a plan view of a washer which is one of the components of the adjustable door hinge of FIG. 1.

In the exemplary embodiment, the upper end of the tubular guide 5 and the lower end of the tubular guide 7 are provided with a rack of parallel teeth 13 as illustrated in FIG. 2. An upper washer 14 surrounds the bolt 10 for disposition between the bolt head 11 and the upper end of tubular guide 5 and a lower washer 15 surrounds the bolt for disposition between the nut 12 and the lower end of tubular guide 7. The washers 14 and 15, as best illustrated in FIG. 3, are also provided with corresponding racks of parallel teeth 17. The teeth of racks 13 and 17 are perpendicular to the plane of hinge plate 1 on which tubular guides 5, 6 and 7 are provided.

Figure 4:
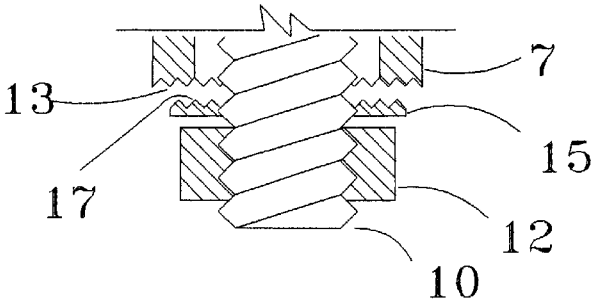
FIG. 4 is a detailed sectional view of the lower end of the adjustable door hinge of FIG. 1.
Figure 5:
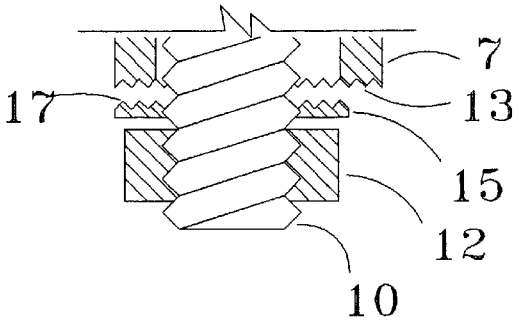
FIG. 5 is a detailed sectional view of the same lower end of the adjustable door hinge of FIG. 1 illustrating side to side adjustment of the hinge plates thereof.

Referring also now to FIGS. 4 and 5, the purpose of the racks 13 and 17 will be more fully understood. FIGS. 4 and 5 illustrate the lower end of the door hinge H but the operation of the components at the upper end of the hinge H is similar to those at the top end of the hinge H.

In FIG. 1, the hinge plates 1 and 2 and the tubular guides 5, 6, 7 and 8, 9 thereof are concentrically aligned. In the fully made up position of FIG. 1, the teeth 17 of washers 14 and 15 fully engage the teeth 13 of the tubular members 5 and 7, respectively, maintaining this concentric alignment and a particular side to side position of one hinge plate 1 relative to the other 2. However, if the nut 12 is sufficiently loosened or disengaged, the washers 14 and 15 and the teeth 17 thereon may disengage the corresponding teeth 13 of tubular guides 5 and 7 respectively. This is illustrated with respect to washer 15 and tubular guide 7 in FIG. 4. Once disengaged, the bolt 10 and the washers 14 and 15 may be moved transversely relative to the rack teeth 13 and 17, as illustrated in FIG. 5, so that the bolt would then be eccentrically disposed relative to the hinge guides 5, 6 and 7 and especially as illustrated with respect to guide 7 in FIG. 5. When so disposed, the nut 12 may then be fully engaged or tightened causing the washers 14 and 15 and the rack of teeth 17 thereon to move into selective position for engagement with the teeth 13 on the corresponding guide 5 and 7. Thus the hinge plates 1 and 2 are horizontally displaced relative to each other. This of course allows for side to side adjustment of the door relative to the door jamb.

In summary, the threaded bolt 10 and threaded guides 8 and 9 allow vertical adjustment of the hinge plate 2 and the door D to which it is attached. Horizontal adjustment is effected by transverse movement of the bolt 10 and washers 14 and 15 relative to the non-threaded guides 5, 6 and 7 and the rack teeth 13 of guides 5 and 7 thereon. All of this is accomplished without disconnecting the hinge plates 1 and 2 and without removing the door D from the door jamb.

A single embodiment of the invention has been described herein. However, many variations may be made without departing from the spirit of the invention. Accordingly it is intended that the scope of the invention be limited only by the claims which follow.

We claim:

1. An adjustable door hinge comprising:

a pair of hinge plates operatively connected for pivoting about a common substantially vertical axis, each of said hinge plates being provided along corresponding juxtapositioned vertical edges thereof with two or more vertically spaced and coaxially aligned tubular guides, the guides of each hinge plate being alternately disposed in spaces between the guides of the outer hinge plate, the length of each guide being vertically less than the corresponding space in which it is disposed, at least two guides of one of said hinge plates being provided with internal threads, the internal diameter of the guides of the other hinge plate being greater than the root diameter of said internal threads, the upper end of one of said tubular guides of said other hinge plate being provided with a rack of parallel teeth;

an externally threaded bolt extending through each of said tubular guides, the threads of said bolt engaging said internal threads of said one of said hinge plates, said bolt having a head which may rest at said upper end of said one of said tubular guides of said other hinge plate, rotation of said bolt effecting vertical displacement of said hinge plates relative to each other; and a washer surrounding said threaded bolt for disposition between said bolt head and said upper end of said one of said tubular guides of said other hinge plate, one side of said washer being provided with a corresponding rack of parallel teeth which with said washer and said bolt may be transversely moved in selective engagement with said tubular guide rack to effect horizontal displacement of said hinge plates relative to each other.

2. The adjustable door hinge of claim 1 including a nut member for engagement with said bolt member and, when made up against the lower end of another of said tubular guides of said other hinge plate, limiting said vertical displacement of said hinge plates relative to each other.

3. The adjustable door hinge of claim 2 in which said internal diameter of said guides of said other hinge plate is great enough to allow substantial eccentric disposition of said bolt relative thereto for effecting horizontal displacement of said hinge plates relative thereto.

4. The adjustable door hinge of claim 2 in which said lower end of said another of said tubular guides of said other hinge plate is provided with another rack of parallel teeth and in which another washer surrounds said bolt for disposition between said nut member and said lower end of said another tubular guide, one side of said another washer being provided with a corresponding rack of parallel teeth which with said another washer may be transversely moved in selective engagement with said another tubular guide rack to effect horizontal displacement of said hinge plates relative to each other.

5. The adjustable door hinge of claim 4 in which the teeth of said rack of parallel teeth provided by said one of said tubular guides are perpendicular to the plane of said other hinge plate on which said tubular guides are provided.

6. The adjustable door hinge of claim 1 in which the teeth of said rack of parallel teeth provided by said one of said tubular guides are perpendicular to the plane of said other hinge plate on which said tubular guides are provided.

7. An adjustable door hinge comprising:

a pair of hinge plates operatively connected for pivoting about a common substantially vertical axis, each of said hinge plates being provided along corresponding juxtapositioned vertical edges thereof with two or more vertically spaced and coaxially aligned tubular guides, the guides of each hinge plate being alternately disposed in spaces between the guides of the other hinge plate, the length of each guide being vertically less than the corresponding space in which it is disposed, the internal diameter of the guides of one of said hinge plates being less than the internal diameter of the guides of the other hinge plate, the upper end of one of said tubular guides of said other hinge plate being provided with a rack of parallel teeth;

a bolt extending through each of said tubular guides, said bolt having a head which may rest at the upper end of one of said tubular guides of said other hinge plate; and a washer surrounding said bolt for disposition between said bolt head and said upper end of said one of said tubular guides of said other hinge plate, one side of said washer being provided with a corresponding rack of parallel teeth which with said washer and said bolt may be transversely moved in selective engagement with said rack of parallel teeth of said one of said tubular guides to effect horizontal displacement of said hinge plates relative to each other.

8. The adjustable door hinge of claim 7 in which the teeth of said rack of parallel teeth provided by said one of said tubular guides are perpendicular to the plane of said other hinge plate on which said tubular guides are provided.

9. The adjustable door hinge of claim 8 in which the outside diameter of both of said washers is greater than the internal diameter of said guides of said other hinge plate and the inside diameter of both of said washers is slightly greater than the major external diameter of said bolt.

10. The adjustable door hinge of claim 7 in which the lower end of another of said tubular guides of said other hinge plate is also provided with a rack of parallel teeth and in which another washer surrounds said bolt for disposition between a nut member, engageable with a threaded end of said bolt, and said lower end of said another tubular guide, one side of said another washer being provided with a corresponding rack of parallel teeth which with said another washer may be transversely moved in selective engagement with said rack of parallel teeth of said another tubular guide to effect horizontal displacement of said hinge plates relative to each other.

* * * * *